US008110778B2

(12) United States Patent
Wong et al.

(10) Patent No.: US 8,110,778 B2
(45) Date of Patent: Feb. 7, 2012

(54) HAIR CRIMPER (LOCAL HEATING)

(75) Inventors: Lik Man Wong, Hong Kong (CN); Tak Keung Cheung, Hong Kong (CN)

(73) Assignee: Dickson Industrial Co., Ltd., Kowloon, Hong Kong (CN)

( * ) Notice: Subject to any disclaimer, the term of this patent is extended or adjusted under 35 U.S.C. 154(b) by 768 days.

(21) Appl. No.: 12/169,302

(22) Filed: Jul. 8, 2008

(65) Prior Publication Data

US 2009/0014024 A1 Jan. 15, 2009

(30) Foreign Application Priority Data

Jul. 10, 2007 (HK) ..... 07107416.4

(51) Int. Cl.
*A45D 2/40* (2006.01)
*A45D 1/04* (2006.01)

(52) U.S. Cl. ..... 219/225; 132/225

(58) Field of Classification Search ..... 132/225
See application file for complete search history.

(56) References Cited

U.S. PATENT DOCUMENTS

| | | | | | |
|---|---|---|---|---|---|
| 3,660,634 | A | | 5/1972 | Scott | |
| 4,226,251 | A | * | 10/1980 | Wall | 132/212 |
| 4,739,151 | A | * | 4/1988 | Smal | 219/225 |
| 4,819,674 | A | * | 4/1989 | Takimae | 132/224 |
| 4,870,250 | A | * | 9/1989 | Rizzuto et al. | 219/225 |
| 5,120,933 | A | | 6/1992 | Altamore et al. | |
| 5,934,293 | A | * | 8/1999 | Kaizuka | 132/225 |
| 6,014,977 | A | * | 1/2000 | Friedman | 132/232 |
| 6,070,596 | A | | 6/2000 | Altamore | |
| 6,223,753 | B1 | * | 5/2001 | Lo | 132/224 |
| 6,386,206 | B2 | * | 5/2002 | Lee | 132/225 |
| 6,627,852 | B1 | * | 9/2003 | Savone | 219/225 |
| RE38,713 | E | * | 3/2005 | Habibi | 132/224 |
| 6,941,955 | B2 | * | 9/2005 | Yao | 132/225 |
| 2001/0022184 | A1 | * | 9/2001 | Lee | 132/225 |
| 2008/0283080 | A1 | * | 11/2008 | Habibi | 132/224 |
| 2008/0283081 | A1 | * | 11/2008 | Habibi | 132/224 |
| 2009/0114240 | A1 | * | 5/2009 | Leung | 132/224 |

FOREIGN PATENT DOCUMENTS

| | | |
|---|---|---|
| DE | 201 19 863 | 4/2003 |
| EP | 0 273 538 | 7/1988 |
| GB | 2 405 584 A | 3/2005 |

OTHER PUBLICATIONS

United Kingdom Search Report.
European Search Report issued in corresponding European Application No. 08 25 2366.

* cited by examiner

*Primary Examiner* — Joseph M Pelham
(74) *Attorney, Agent, or Firm* — Buchanan Ingersoll & Rooney PC

(57) ABSTRACT

A hair crimper comprising a pair of complementary hair crimping surfaces which are configured for hair crimping by application of heat and pressure to hair when cooperatively engaged, wherein each one of said complementary hair crimping surfaces comprises a corrugated hair styling surface which defines a transversal hair shaping profile, characterized in that, said complementary hair crimping surfaces are configured to cooperatively apply heat at predetermined intervals along said transversal hair shaping profile.

18 Claims, 5 Drawing Sheets

HAIR CRIMPER (LOCAL HEATING)

FIELD OF THE INVENTION

The present invention relates to a hair styling apparatus, and more particularly, to a hair crimping apparatus.

BACKGROUND OF THE INVENTION

A crimping apparatus, or a hair crimper in short, is a type of hair styling apparatus which is designed to produce hair styling by application of heat and pressure to hair engaged between a pair of form-defining members. A typical hair crimper comprises a pair of complementary hair crimping members each having a transverse hair shaping profile. The transversal hair shaping profiles of the pair of hair crimping surfaces are substantially complementary, and the pair of crimping members are arranged so that when the pair of crimping members are cooperatively engaged, a length of hair transversely engaged between the crimping members will be under a crimping pressure exerted by the pair of crimping members. When heat is applied to the hair engaged between the pair of crimping surfaces, the engaged hair will be thermally set by the applied heat under crimping pressure. As a result, the hair will be set to follow the transverse hair shaping profile of the crimping members. Curls, ripples, waves, folds, creases or other corrugated styling shapes are common hair styling variations which are provided for by known hair crimpers.

In a conventional hair crimper, a hair crimping surface is usually formed as an integral part of a hair crimping member. The hair crimping member is usually formed as a moulded metallic block on which there is disposed a plurality of elongate and parallel hair shaping members protruding from the base of the moulded metallic block which defines the hair crimping surface. The plurality of parallel and elongate hair shaping members collectively define a corrugated surface having a transverse hair shaping profile, and the transverse hair shaping profile in turn defines the longitudinal profile of a length hair after crimping has been performed in the usual manner. The metallic blocks on the pair of crimping members are heated simultaneously in order to provide the necessary crimping heat.

Although conventional hair crimpers are regarded as mostly adequate in so far as hair styling is concerned, improvements in relation to the design of the crimping members, especially a design which leads to improvements in relation to the efficient use of heat, are desirable.

SUMMARY OF THE INVENTION

According to the present invention, there is provided a hair crimping apparatus, or a hair crimper in short, comprising a pair of complementary hair crimping surfaces which are configured for hair crimping by application of heat and pressure to hair when cooperatively engaged, wherein each one of said complementary hair crimping surfaces comprises a corrugated hair styling surface which defines a transversal hair shaping profile, characterized in that, said complementary hair crimping surfaces are configured to cooperatively apply heat at predetermined intervals along said transversal hair shaping profile.

By providing a hair crimper in which crimping heat is applied at intervals along the transverse hair shaping profile, only a fraction of crimping heat is required compared to the heat required to heat up a conventional hair crimp in which the entire crimping member needs to be heated up. This facilitates saving in crimping energy.

The crimping surfaces may be arranged so that crimping heat is applied to hair at locations which are definitive of the styling profile to be formed. For example, the crimping members may be configured so that localized crimping heat is applied at locations corresponding to or coinciding with the peaks and troughs of the corrugated hair styling surface, which in turn correspond to the peaks and troughs of the hair ripples or creases to be formed. Such a configuration has the further benefit of reducing damage to hair due to high temperature crimping, since a smaller portion of hair is heated under heat and pressure.

BRIEF DESCRIPTION OF THE DRAWINGS

Preferred embodiments of the present invention will be explained in further detail below by way of examples and with reference to the accompanying drawings, in which:—

DETAILED DESCRIPTION OF THE PREFERRED EMBODIMENTS

Figure 1:
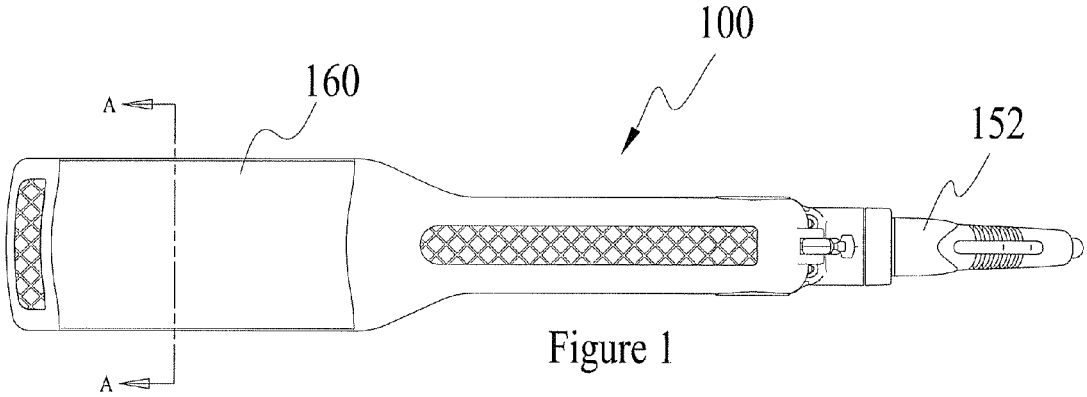
FIG. 1 is a top view of a hair crimper of a first embodiment of the present invention.

A hand-held hair crimper 100 illustrating a first exemplary embodiment of the present invention is shown in FIGS. 1-6. The hair crimper comprises a pair of hair crimping members 120, 140 which are respectively mounted at corresponding locations on a housing 160 which comprises a pair of hinge 162 joined handle portions 164, 166. The housing, including the handle portions, comprises parts moulded from an insulating material such as durable plastics. Each of the hair crimping members comprises a hair crimping surface 122, 142 which defines a transversal hair shaping profile, as more particularly shown in FIGS. 3A and 5. The hair crimping surfaces are complementarily shaped so that when the hair crimping members are cooperatively engaged, a length of hair transversely engaged between the pair of crimping members will be set following the transversal hair shaping profile of the hair crimping surface.

Figure 2:
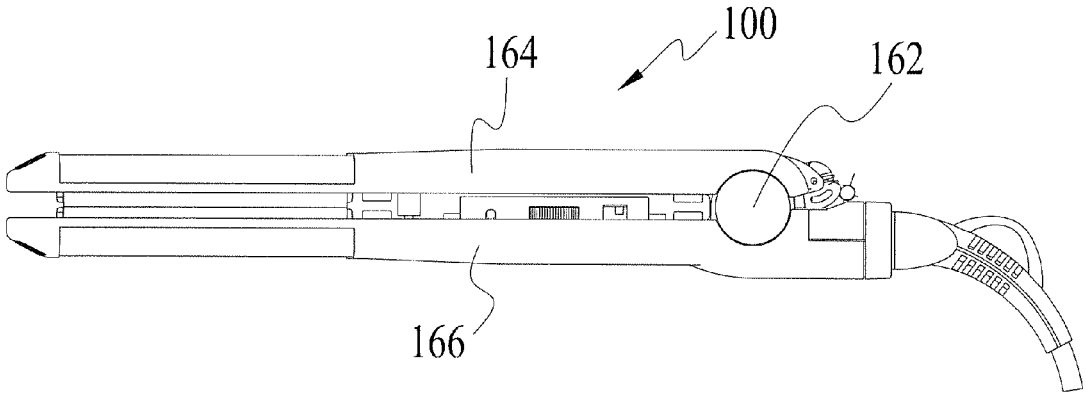
FIG. 2 is a side view of the hair crimper of FIG. 1.
Figure 4:
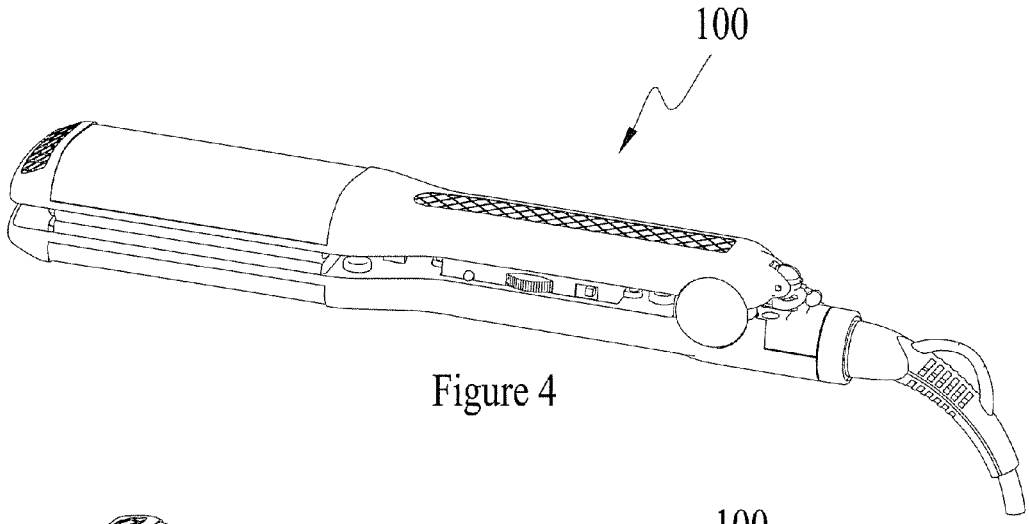
FIG. 4 is a perspective view of the hair crimper of FIG. 1 in its crimping configuration.
Figure 5:
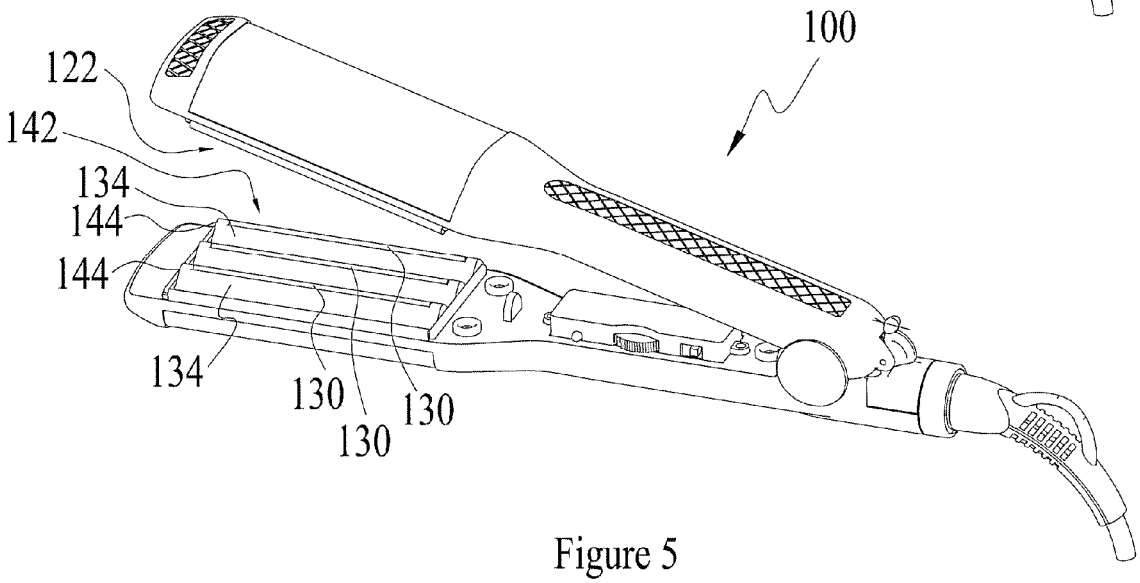
FIG. 5 is a perspective view of the hair crimper of FIG. 1 in its release configuration.

As shown in the Figures, the hair crimping members are respectively mounted on the handle portions at corresponding locations distal from the hinged end of the handle portions and with their respective hair crimping surface opposite each other. To facilitate hair shaping and releasing, the handle portion is moveable between a crimping position, at which the pair of crimping members are cooperatively engaged, as shown in FIGS. 2 and 4, and a release position, at which hair can be inserted for crimped styling or removed after styling has been completed, as shown in FIG. 5.

Figure 3:
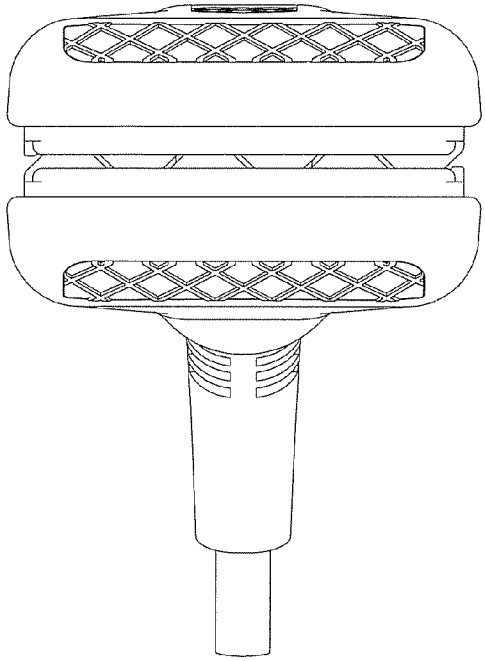
FIG. 3 is a front view of the hair crimper of FIG. 1.
Figure 3A:
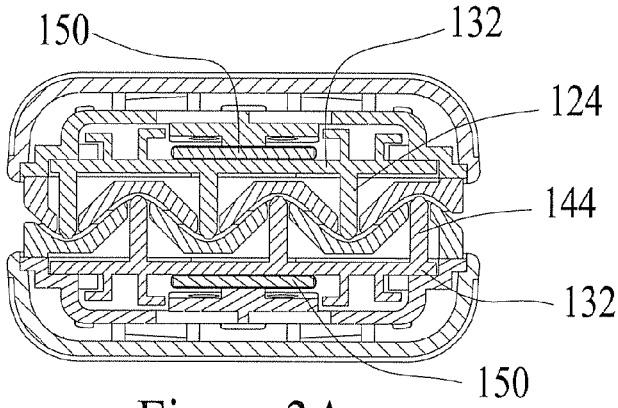
FIG. 3A is a transversal cross-sectional view of the hair crimper of FIG. 1 along the section line A-A.
Figure 3B:
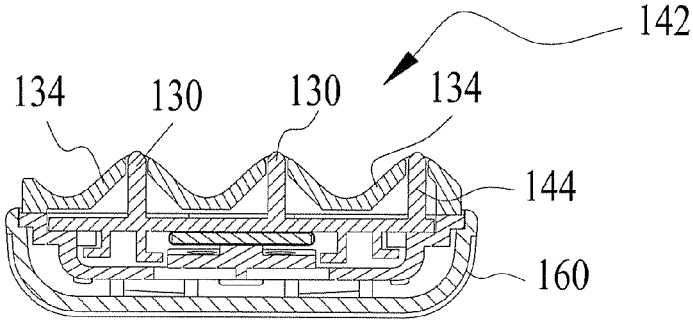
FIG. 3B is a transversal cross-sectional view of the lower portion of the hair crimper of FIG. 1 along the section line A-A.

Each hair crimping surface is defined by a plurality of elongate hair shaping members 124, 144 which in turn collectively defines the transverse hair shaping profile of the hair crimper. The pair of crimping members are arranged such that, during crimping operation, that is, when the crimper is at its crimping position, the ridge portion 130 of a hair shaping member of a hair crimper surface engages with the corresponding trough portion on a hair shaping member of the opposite hair crimping surface. A typical transverse hair shaping profile for hair crimpers is corrugated, as shown in FIGS. 3A and 3B, and comprises peak and trough portions which collectively determine the amplitude of hair ripples or waves to be formed after crimping. The peak and trough portions, or their functional equivalents, are definitive of the transversal hair shaping profile upon crimping, since the peak and trough portions determine the locations or intervals at which the direction of hair changes upon crimping.

Each elongate hair shaping member is intermediate a pair of trough portions and comprises a ridge portion which is distal and protrudes from the base portion 132 of the hair crimping member. The ridge portion is the narrowest portion, and has the maximum curvature, on the transversal profile of the hair shaping member, such that an appropriate and effective crimping pressure can be applied by the ridge portions for hair crimping when the pair of hair crimping members are cooperative engaged at its crimping position. In addition to the ridge portion, each hair shaping member also comprises a pair of side members 134 which embrace the ridge portion, with the ridge portion intermediate the pair of side members.

The assembly comprising the ridge portion and the pair of side members collectively defines the transversal hair shaping profile of a hair shaping member. While the peak and trough portions of the hair shaping members will operate to determine the amplitudes or extremities of the hair ripples to be formed, the pair of side members will determine the shape of hair intermediate the extremities upon crimping. In this example, the side members together define a pair of sloping surfaces which are divergent from the ridge portion.

To maximize heating efficiency, crimping heat is applied only, or at least primarily, at the ridge portions, since these are the locations which are definitive and critical of the transversal profile of hair to be formed. To facilitate crimping heat to be applied only through the ridge portions, a slot 136 is formed intermediate the pair of side members and the slot is configured so that the ridge portion protrudes from the slot during crimping operation, for example, in a closely fitted manner. To mitigate heat loss and to enhance heating efficiency, the pair of side members is formed from an insulating material such as durable plastics. By sandwiching the ridge portion by a pair of insulating side members, and allowing a ridge portion to be exposed through the slot, effective crimping heat will be applied only at the ridge portions. Since the ridge portions are located at pre-determined intervals along the transverse hair shaping profile of a hair crimping member, crimping heat will also be applied at pre-determined intervals corresponding to the ridge portions or other shape defining features of the pair of crimping members. Accordingly, only a fraction of crimping heat is required compared to the heat required to heat up an entire hair crimping surface of a conventional hair crimper.

Figure 6:
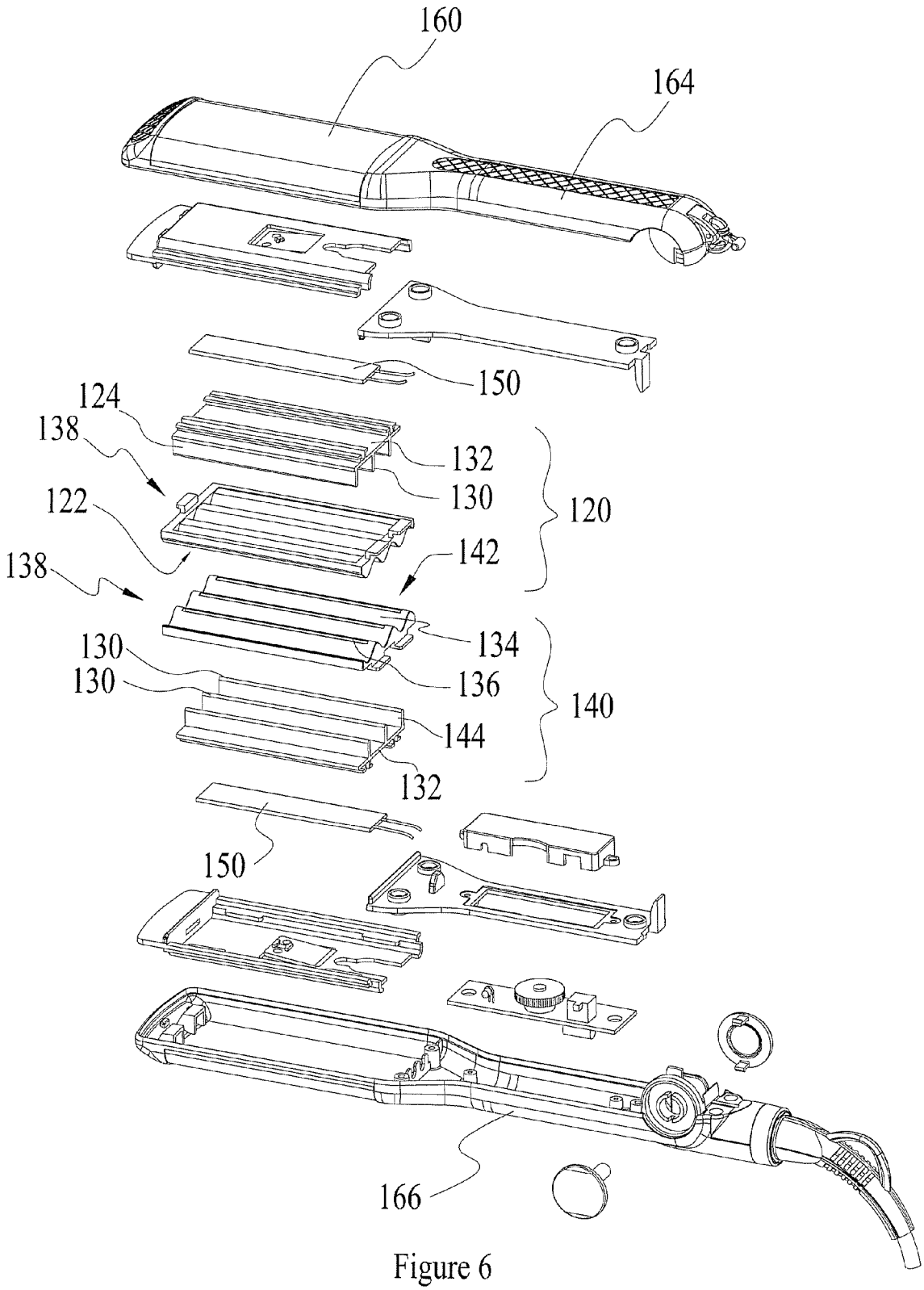
FIG. 6 is an exploded view showing the component relationship of the hair crimper of FIG. 1.

Turning next to an exemplary construction of the hair crimper of FIGS. 1-5 with particular reference to FIG. 6 in which the components are shown in an exploded view, hair crimping members 120, 140 are respectively mounted on the respective housings of the pair of handle portions. Each one of the handle portions comprises a moulded plastic housing which defines a hollow compartment for accommodating the various components for the crimper to function, including a hair crimping member. A hair crimping member 120, 140 is formed as a sub-assembly comprising an insulated corrugated top member 138 and a thermally conductive or metallic base member. The top member is moulded from plastics or other insulating material and comprises a plurality of elongate protrusions defined by a pair of sloping side members and a slot intermediate the pair of side members. The base member comprises a plurality of fin-shaped ridge portions which extends upwardly from a base portion, and the fin-shaped ridge portions are parallel to each other. The length and width (or more specifically, the edge thickness) of the uppermost portion of a fin-shaped ridge portion is configured so that, when the hair shaping member is assembled with the top cover clipped on the base block, the uppermost portion of the fin-shaped ridge portion will expose through the slot in a closely fitted manner. In addition, the arrangement of the base member and the top member is such that, when the base member and the top member is assembled, the plurality of fin-shaped ridge portions will protrude and/or expose through the corresponding plurality of slots of the top member. To meet this requirement, the pitch of the fin-shaped ridge portion, that is the transverse separation between an adjacent pair of fin-shaped ridge portion, is equal to the pitch of the corrugation on the top cover member. More specifically, the pitch of the fin-shaped ridge portion is equal to the pitch of the corrugated top member as defined by the peak-to-peak separation of the corrugations.

The base member is a metallic block moulded from aluminum or an aluminum alloy which is selected for its light weight and good thermal conductivity. A heating means or element 150 is attached to the back side of the base member to provide crimping heat to ridge portions located on the front or upper side of the base member. As the mass of the base member is significantly less than that of a conventional hair shaping member having the same transverse hair shaping profile, the heat required to heat up the ridge portions for crimping operation would be significantly less than that required to heat up a conventional hair shaping member in which the entire transverse hair shaping profile is formed by metal. The insulated top cover further helps to retain heat and to mitigate heat loss. To facilitate operation of the hair crimper, the heating element is connected to the mains supply via a swivel cord 152 and the power supply is switch-able by a switch, as is known to persons skilled in the art. An extension of the power cord runs through the portion of the compartment in order to connect to the heating elements.

During operation, a user will turn on the heating elements. The heating elements will heat up the ridge portions and a display will provide a visual indication when an appropriate crimping temperature has been reached. At this instance, a user can lay a length of hair transversely across the hair shaping members and then close the pair of handle portions for an appropriate time. The heat and pressure applied by the ridge portions will then set the hair according to and in conformity to the transverse hair shaping profile defined by the pair of hair shaping members to complete crimping. The hair will be released by opening the pair of hair crimping surfaces when crimping has been completed.

Figure 7:
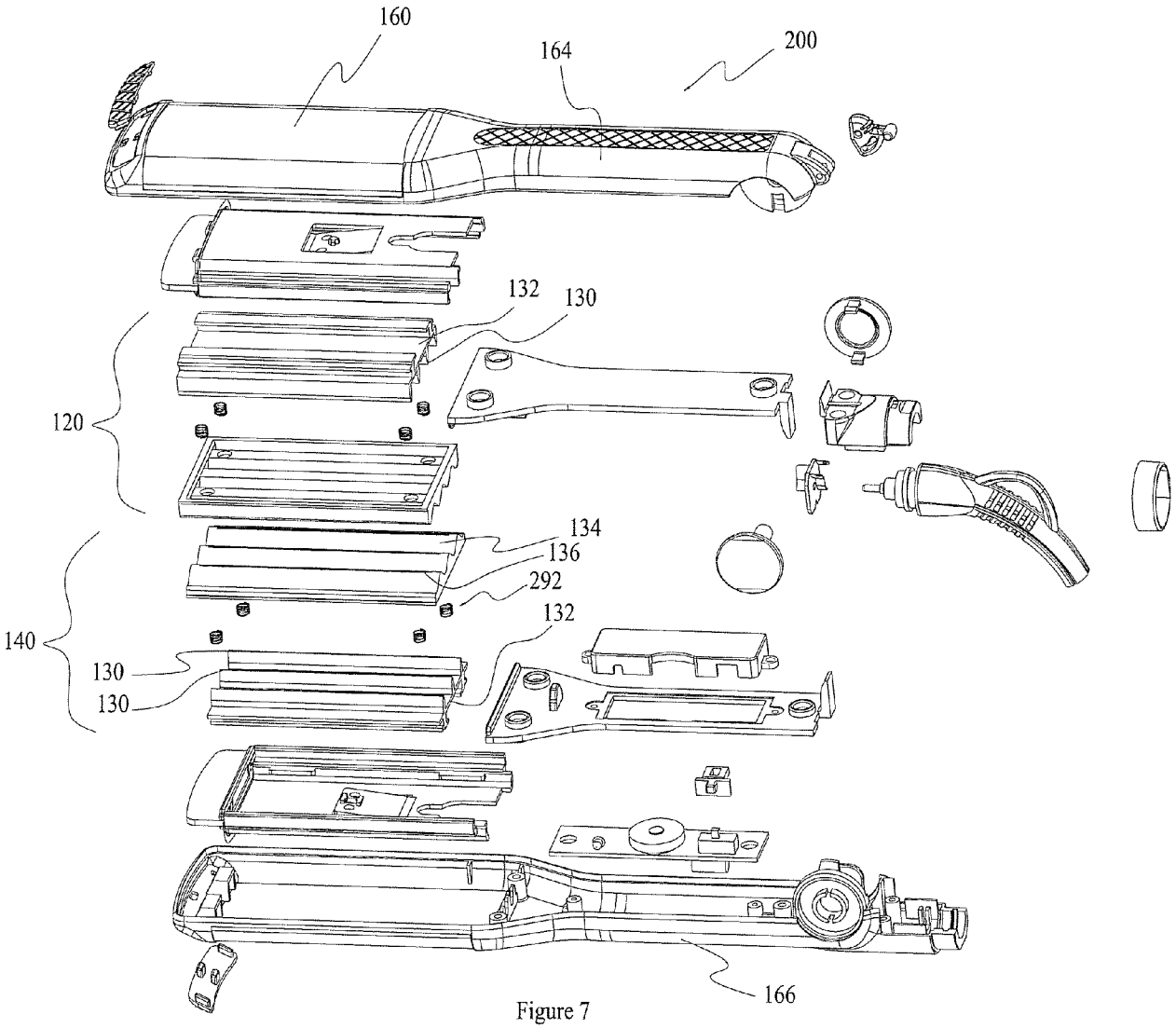
FIG. 7 is an exploded view showing the component relationship of a second embodiment of a hair crimper of the present invention.

In a second embodiment of a hair crimper 200 as shown in FIG. 7, the construction is substantially identical to that above, and like numerals are used to refer to like parts. In this embodiment, the base member carrying the plurality of fin-shaped ridge portions are mounted under spring bias so that the ridge portions are retracted from the slots of the top cover by spring bias when the crimper is at its release position. The spring urged mounting of the base member is further arranged so that, when the crimper is moved into the crimping portion, the fin-shaped ridge portions will protrude and expose through the slots to perform heated crimping. With such an arrangement, the heated portions of the crimpers are substantially concealed when in the release position for added safety. To implement this, a plurality of spring or resilient members 292 is disposed or distributed intermediate the top cover and the base member so that the base member is urged away from the top cover in a direction to retract the ridge portions.

Although the plurality of ridge portions are formed integrally with the base member, it will be appreciated that individual fin-shaped ridge portions can be utilized to form the shape defining ridge portions.

While the present invention has been explained by reference to the examples or preferred embodiments described above, it will be appreciated that those are examples to assist understanding of the present invention and are not meant to be restrictive. Variations or modifications which are obvious or trivial to persons skilled in the art, as well as improvements made thereon, should be considered as equivalents of this invention.

Furthermore, while the present invention has been explained by reference to a hair crimper in which the ridge portions are integrally moulded on a single block, it should be appreciated that the invention can apply, whether with or without modification, to other embodiments without loss of generality.

The invention claimed is:

1. A hair crimper for crimping one or more tresses of hair of a user, comprising:

a pair of complementary hair crimping surfaces which are configured for hair crimping by application of heat and pressure to the tresses of hair of a user when cooperatively engaged, wherein each one of said complementary hair crimping surfaces comprises a corrugated hair styling surface which defines a hair shaping profile for orientation substantially transverse to the tresses of hair to be crimped, said complementary hair crimping surfaces being configured to cooperatively apply heat at predetermined intervals along said transversal hair shaping profile, and each one of said pair of complementary hair crimping surfaces comprising a plurality of hair shaping members, each said hair shaping member being collectively defined by a ridge portion which is intermediate a pair of sloping surfaces;

wherein said ridge portion is connected to a heat source, and said first and second sloping surfaces are thermally insulated.

2. A hair crimper according to claim 1, wherein each one of said hair crimping surface comprises a plurality of elongate hair shaping members which are parallel and which collectively define said corrugated hair styling surface.

3. A hair crimper according to claim 2, wherein each said elongate hair shaping member comprises an elongate protruding portion intermediate a pair of troughs, and an elongate protruding portion on one of said hair crimping surface being arranged and configured for complementary reception by a corresponding trough portion on another one of said hair crimping surfaces;

wherein said crimper is configured for applying localised crimping heat and pressure to hair at locations where the peak of a said elongate protruding portion on one crimping surface meets the bottom of said trough portion on another said crimping surface.

4. A hair crimper according to claim 2, wherein heat is applied locally to hair engaged between said protrusion portion and said trough portion when said pair of complementary hair crimping surfaces are cooperatively engaged.

5. A hair crimper according to claim 3, wherein a said elongate protrusion portion defines a ridge portion which is configured for applying localised heat and pressure to hair engaged between said protrusion portion and said trough portion, said ridge portion defining a change in hair curvature of hair slope.

6. A hair crimper according to claim 2, wherein said ridge portion is arranged to provide localised heat and pressure for crimping hair which is engaged between said pair of crimping surfaces, and said pair of insulated sloping surfaces is arranged against leakage of heat there-through.

7. A hair crimper according to claim 1, wherein each said hair crimping surface comprises a plurality of hair shaping members arranged in parallel.

8. A hair crimper according claim 2, wherein a hair shaping member is located intermediate a pair of parallel trough portions on a said hair crimping surface.

9. A hair crimper according to claim 2, wherein a trough portion is located intermediate a pair of sloping surfaces which converge towards said trough portion.

10. A hair crimper according to claim 1, wherein the ridge portions of said plurality of said hair shaping members being integrally formed from a single metallic piece.

11. A hair crimper according to claim 10, wherein said plurality of hair shaping members is formed as an assembly comprising a moulded metallic block having a plurality of fins or ridges protruding there-from, and a moulded cover member having a plurality of insulated corrugated members; and wherein each said corrugated member comprises a pair of divergent sloping surfaces which defines a slot at the junction between said pair of sloping surfaces, and a said ridge portion is exposed through said slot.

12. A hair crimper according to claim 11, wherein said metallic block is thermally connected to a heating source, and said assembly is arranged so that heat is transferred to hair through said ridge portions only hair crimping operation.

13. A hair crimper according to claim 10, wherein said metallic block is moveable mounted on a housing such that said ridge portion is retractable and protrude-able relative to said slot.

14. A hair crimper according to claim 13, wherein said metallic block is under spring bias to retract said ridge portion from said slot when said pair of hair crimping surfaces is not cooperatively engaged, and said metallic block is biased to protrude said ridge portion to expose from said slot when said pair of crimping surfaces are co-operatively engaged.

15. A hair crimper according to claim 2, further comprising a handle portion which is pivotally movable between a hair crimping position and a release position, wherein said ridge portions extend transversally to the pivotal axis of said handle portion.

16. A hair crimper according to claim 1, wherein said pre-determined intervals at which localized heat is applied coincide with peaks and troughs of said corrugated hair styling surface.

17. A hair crimper according to claim 16, wherein the spacing of said pre-determined intervals is determined by the transversal pitch of corrugation of said corrugated hair styling surface.

18. A hair crimper according to claim 17, wherein said spacing equals to half the transversal pitch of corrugation.

* * * * *